US009171499B2

(12) United States Patent
Park

(10) Patent No.: US 9,171,499 B2
(45) Date of Patent: Oct. 27, 2015

(54) ORGANIC LIGHT EMITTING DISPLAY CAPABLE OF DETECTING A SHORT CIRCUIT AND METHOD OF DRIVING THE SAME

(75) Inventor: Sung-Cheon Park, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 835 days.

(21) Appl. No.: 13/250,407

(22) Filed: Sep. 30, 2011

(65) Prior Publication Data

US 2013/0002736 A1 Jan. 3, 2013

(30) Foreign Application Priority Data

Jun. 30, 2011 (KR) ..... 10-2011-0064434

(51) Int. Cl.
*G09G 5/10* (2006.01)
*G09G 3/32* (2006.01)

(52) U.S. Cl.
CPC ..... *G09G 3/3225* (2013.01); *G09G 2300/0861* (2013.01); *G09G 2330/025* (2013.01); *G09G 2330/04* (2013.01); *G09G 2330/12* (2013.01)

(58) Field of Classification Search
CPC G09G 3/3225; G09G 3/3233; G09G 2330/12
USPC ..... 345/76–82, 691
See application file for complete search history.

(56) References Cited

U.S. PATENT DOCUMENTS

| | | | | |
|---|---|---|---|---|
| 5,678,077 | A * | 10/1997 | Ichikawa et al. | 396/205 |
| 6,518,962 | B2 * | 2/2003 | Kimura et al. | 345/211 |
| 7,042,427 | B2 * | 5/2006 | Inukai | 345/77 |
| 2005/0280616 | A1 * | 12/2005 | Miwa et al. | 345/77 |
| 2007/0040772 | A1 * | 2/2007 | Kim | 345/76 |
| 2007/0210722 | A1 * | 9/2007 | Konno et al. | 315/185 S |
| 2008/0055211 | A1 * | 3/2008 | Ogawa | 345/77 |
| 2008/0143655 | A1 * | 6/2008 | Ko | 345/82 |
| 2008/0303754 | A1 * | 12/2008 | Murata et al. | 345/76 |
| 2009/0027375 | A1 * | 1/2009 | Ryu et al. | 345/212 |
| 2009/0201281 | A1 * | 8/2009 | Routley et al. | 345/212 |
| 2010/0103160 | A1 * | 4/2010 | Jeon et al. | 345/213 |
| 2011/0007435 | A1 * | 1/2011 | Dong et al. | 361/18 |
| 2012/0050249 | A1 * | 3/2012 | Jin et al. | 345/212 |
| 2012/0105749 | A1 * | 5/2012 | Tseng et al. | 349/15 |

FOREIGN PATENT DOCUMENTS

| | | |
|---|---|---|
| KR | 10-2006-0077833 (A) | 7/2006 |
| KR | 10-0999063 (B1) | 12/2010 |

* cited by examiner

*Primary Examiner* — Koosha Sharifi-Tafreshi
*Assistant Examiner* — Crystal A Mathews
(74) *Attorney, Agent, or Firm* — Knobbe Martens Olson & Bear, LLP

(57) ABSTRACT

An organic light emitting display is disclosed. The display includes a pixel unit for displaying a black image during a non-emission period and for displaying an image based on data during an emission period in every frame period. The display also includes a current sensor which determines current flowing in a power line during the non-emission period and generates a stop signal if the current is greater than a threshold, and a power supply which supplies power to the pixel unit unless the stop signal is received from the sensor.

20 Claims, 3 Drawing Sheets

ORGANIC LIGHT EMITTING DISPLAY CAPABLE OF DETECTING A SHORT CIRCUIT AND METHOD OF DRIVING THE SAME

CROSS-REFERENCE TO RELATED APPLICATIONS

This application claims priority to and the benefit of Korean Patent Application No. 10-2011-0064434, filed on Jun. 30, 2011, in the Korean Intellectual Property Office, the entire content of which is incorporated herein by reference.

BACKGROUND

1. Field

The disclosed technology relates to an organic light emitting display and a method of driving the same, and more particularly, to an organic light emitting display capable of detecting whether a short is generated without affecting the driving of the organic light emitting display and a method of driving the same.

2. Description of the Related Technology

Recently, various flat panel display (FPD) technologies having reduced weight and volume as compared to cathode ray tubes (CRT) have been developed. By way of example, FPDs include liquid crystal displays (LCD), field emission displays (FED), plasma display panels (PDP), and organic light emitting displays.

Organic light emitting displays display images using organic light emitting diodes (OLED) that generate light through the re-combination of electrons and holes. Organic light emitting displays have high response speed and are driven with low power consumption.

In general, an OLED display may be either a passive matrix type display (PMOLED) or an active matrix type display (AMOLED) according to a method of driving the display.

The AMOLED includes a plurality of gate lines, a plurality of data lines, a plurality of power source lines, and a plurality of pixels coupled to the lines arranged in a matrix. In such an organic light emitting display, power source lines may be formed to overlap each other or power source lines and data lines may overlap each other. However, when lines that overlap are shorted by a manufacturing defect, such as a particulate, over-current may be generated. Furthermore, in some cases a single short generates only a small amount of current, and it is therefore difficult to sense.

SUMMARY OF CERTAIN INVENTIVE ASPECTS

One inventive aspect is an organic light emitting display. The display includes a pixel unit configured to display a black image during a non-emission period and for displaying an image according to data signals during an emission period during every frame period. The display also includes a DC-DC converter configured to supply a first power voltage to the pixel unit through a first power source line and for stopping supply of the first power voltage when a stop signal is received, and a current sensing unit configured to measure an amount of current that flows through the first power source line during the non-emission period and to supply the stop signal to the DC-DC converter if the amount of measured current is greater than or equal to a reference current value.

Another inventive aspect is a method of driving an organic light emitting display. The method includes displaying a black image in a non-emission period and displaying an image based on data during an emission period of each frame period and measuring an amount of current of a first power source line for transmitting a first power voltage from a DC-DC converter to a pixel unit during the non-emission period. The method also includes supplying a stop signal to the DC-DC converter if the amount of measured current is greater than or equal to a reference current value, and stopping supply of the first power voltage if the DC-DC converter receives the stop signal.

Another inventive aspect is an organic light emitting display. The display includes a pixel unit for displaying a black image during a non-emission period and for displaying an image according to data signals during an emission period during every frame period. The display also includes a power supply for supplying a first power voltage to the pixel unit through a first power source line and for stopping supply of the first power voltage when a stop signal is received, and a current sensing unit for measuring an amount of current that flows through the first power source line during the non-emission period and for supplying the stop signal to the power supply if the amount of measured current is greater than a reference current value.

BRIEF DESCRIPTION OF THE DRAWINGS

The accompanying drawings, together with the specification, illustrate exemplary embodiments, and, together with the description, serve to explain various aspects, features, and principles.

DETAILED DESCRIPTION OF CERTAIN INVENTIVE EMBODIMENTS

Figure 1:
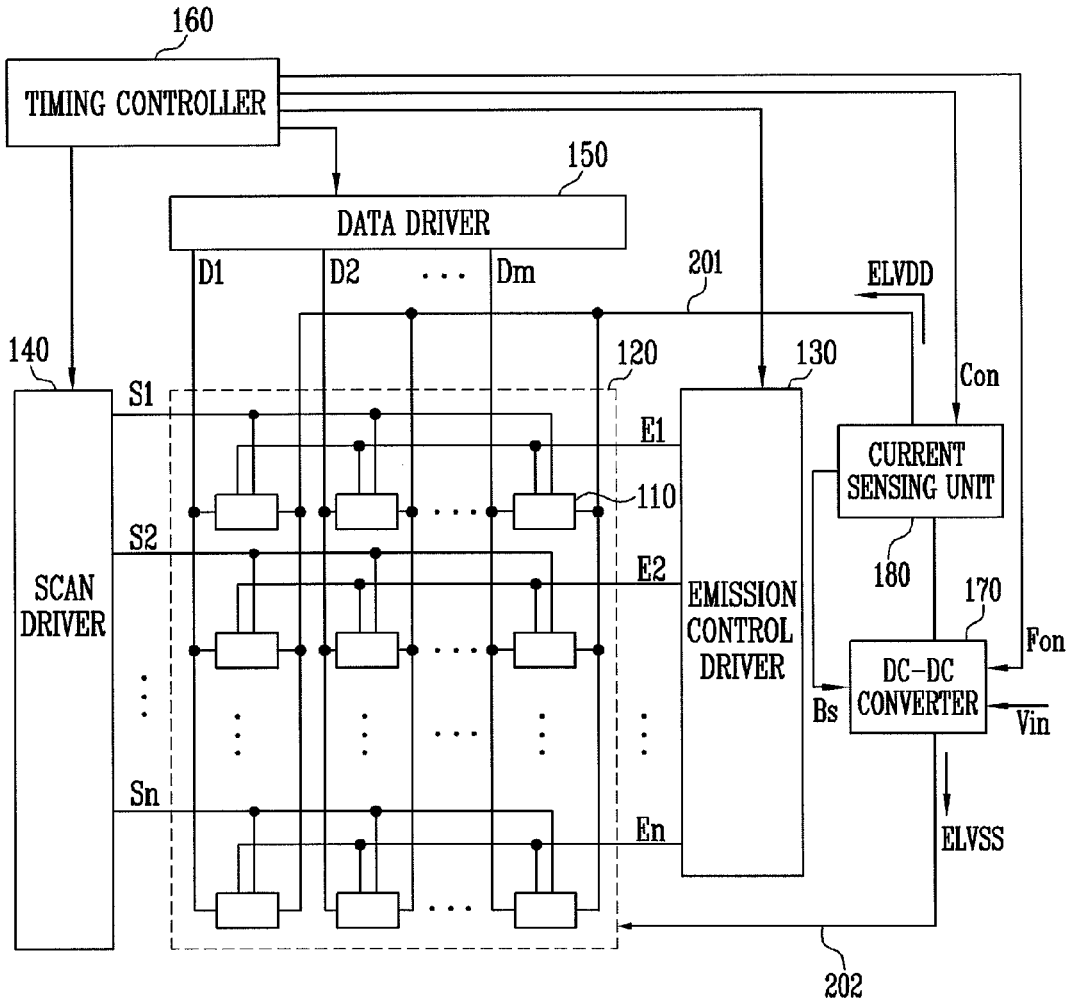
FIG. 1 is a block diagram illustrating an organic light emitting display according to an embodiment.

Hereinafter, certain exemplary embodiments are described with reference to the accompanying drawings. Here, when a first element is described as being coupled to a second element, the first element may be not directly coupled to the second element but may be indirectly coupled to the second element via a third element. Further, some of the elements that are not essential to the complete understanding of the invention are omitted for clarity. Also, like reference numerals generally refer to like elements throughout.

Detailed items of the other embodiments are included in detailed description and drawings. Various advantages and characteristics of the embodiments and a method of achieving the advantages and characteristics of the embodiments are described more fully with reference to the accompanying drawings, in which exemplary embodiments are shown. The aspects, features, and characteristics may, however, be embodied in many different forms and should not be construed as being limited to the embodiments set forth herein. In the drawings, when a part is coupled to another part, the part may be directly coupled to another part and the part may be electrically coupled to another part with another element interposed. In the drawings, a part that is not related to a feature discussed may be omitted for clarity of description. The same reference numerals in different drawings generally represent the same element, and in some instances their description may be omitted.

Hereinafter, an organic light emitting display and a method of driving the same are described with reference to the embodiments the drawings thereof.

Figure 2:
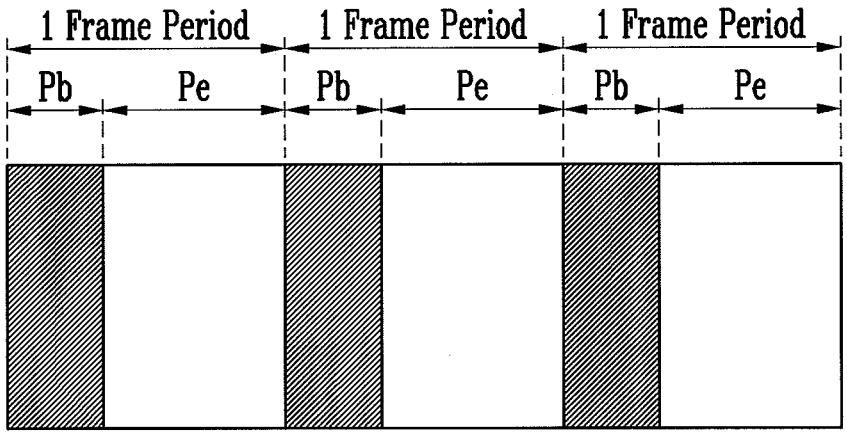
FIG. 2 is a timing diagram illustrating the frame periods of the organic light emitting display according to an embodiment.

FIG. 1 is a block diagram illustrating an organic light emitting display according to an embodiment. FIG. 2 is a timing diagram illustrating frame periods of the organic light emitting display according to an embodiment.

The organic light emitting display of FIG. 1 includes a pixel unit 120, a DC-DC converter 170, and a current sensing unit 180 and may additionally include a scan driver 140, a data driver 150, an emission control driver 130, and a timing controller 160. The pixel unit 120 displays an image every frame period and includes scan lines S1 to Sn, data lines D1 to Dm, and a plurality of pixels 110 coupled to a first power voltage ELVDD and a second power voltage ELVSS.

At this time, the pixels 110 that receive the first power voltage ELVDD and the second power voltage ELVSS generate light components corresponding to data signals by the currents that flow from the first power voltage ELVDD to the second power voltage ELVSS via organic light emitting diodes (OLED). In addition, each frame period includes a non-emission period Pb that displays a black image and an emission period Pe that displays an image based on image data. Therefore, the organic light emitting display may be driven by a simultaneous emission method.

In the simultaneous emission method, the data signals for determining the brightness components of the pixels 110 are sequentially input to the pixels 110 in the non-emission period Pb and the pixels 110 simultaneously emit light with the brightness components corresponding to the data signals in the emission period Pe after data are input.

The scan driver 140 generates scan signals by the control of the timing controller 160 and supplies the generated scan signals to the pixels 110 through scan lines S1 to Sn. The data driver 150 generates the data signals by the control of the timing controller 160 and supplies the generated data signals to data lines D1 to Dm. If the scan signals are sequentially supplied to the scan lines S1 to Sn, the pixels 110 are sequentially selected by lines and the selected pixels 110 receive the data signals received from the data lines D1 to Dm. In addition, the emission control driver 130 generates emission control signals by the control of the timing controller 160 and supplies the generated emission control signals to the pixels 110 through emission control lines E1 to En.

In FIG. 1, the emission control driver 130 is separately illustrated from the scan driver 140. However, the emission control driver 130 may be integrated with the scan driver 140. The timing controller 160 may control the operations of the emission control driver 130, the scan driver 140, the data driver 150, and the DC-DC converter 170.

Figure 3:
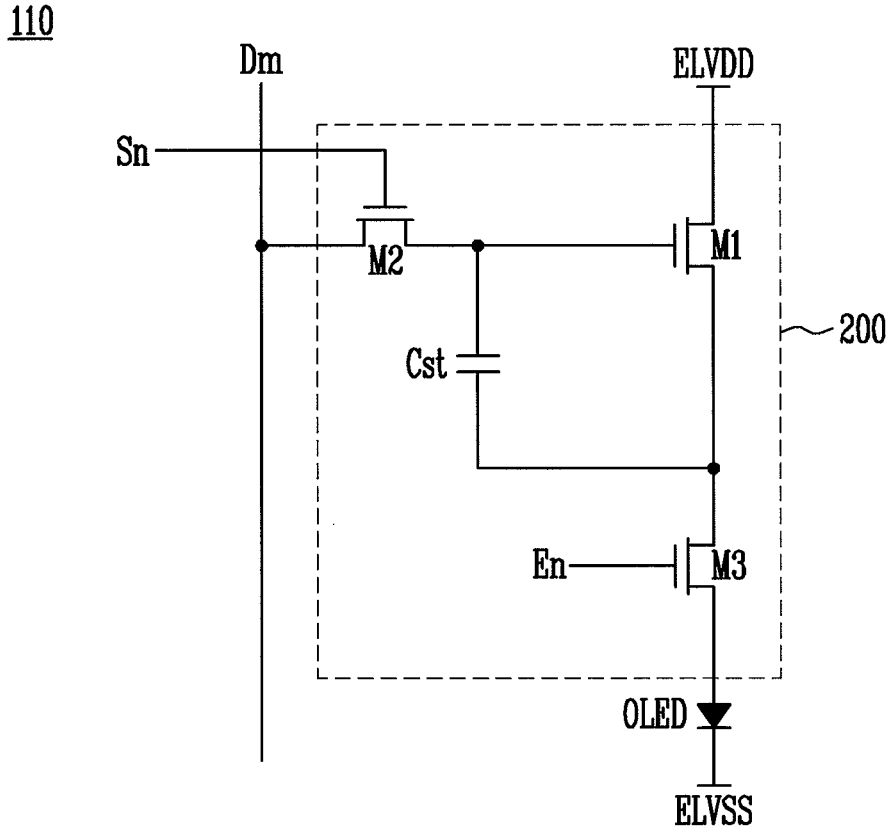
FIG. 3 is a schematic diagram illustrating a pixel according to an embodiment.

FIG. 3 is a schematic view illustrating a pixel according to an embodiment. In FIG. 3, for convenience sake, the pixel coupled to the nth scan line Sn and the mth data line Dm is illustrated.

Referring to FIG. 3, each pixel 110 includes an organic light emitting diode OLED and a pixel circuit 200 coupled to the data line Dm and the scan line Sn to control the amount of current supplied to the OLED.

The anode electrode of the OLED is coupled to the pixel circuit 200 and the cathode electrode of the OLED is coupled to the second power voltage ELVSS. The OLED generates light with brightness corresponding to the current supplied from the pixel circuit 200. The pixel circuit 200 controls the current that flows from the first power voltage ELVDD to the second power voltage ELVSS via the OLED according to the data signal supplied to the data line Dm when a scan signal is supplied to the scan line Sn.

Therefore, the pixel circuit 200 includes first to third transistors M1 to M3 and a storage capacitor Cst. The first transistor M1 as a driving transistor generates the current corresponding to the voltage applied between the gate electrode and the second electrode to supply the generated current to the OLED. Therefore, the first electrode of the first transistor M1 is coupled to the first power voltage ELVDD, the second electrode of the first transistor M1 is coupled to the first electrode of the third transistor M3, and the gate electrode of the first transistor M1 is coupled to the first electrode of the second transistor M2.

The first electrode of the second transistor M2 is coupled to the gate electrode of the first transistor M1, the second electrode of the second transistor M2 is coupled to the data line Dm, and the gate electrode of the second transistor M2 is coupled to the scan line Sn. In addition, the second transistor M2 is turned on when the scan signal is supplied from the scan line Sn to transmit the data signal supplied from the data line Dm to the gate electrode of the first transistor M1 and is turned off when the scan signal is not supplied to block the transmission of the data signal.

The first electrode of the third transistor M3 is coupled to the second electrode of the first transistor M1, the second electrode of the third transistor M3 is coupled to the anode electrode of the OLED, and the gate electrode of the third transistor M3 is coupled to the control line En. In addition, the third transistor M3 is turned on when an emission control signal is supplied from the emission control line En to electrically couple the anode electrode of the OLED to the second electrode of the first transistor M1. Therefore, the current generated by the first transistor M1 flows to the OLED in accordance with the voltage charged in the storage capacitor Cst.

The storage capacitor Cst has one terminal coupled to the gate electrode of the first transistor M1 and has the other terminal coupled to the second electrode of the first transistor M1 to charge the voltage corresponding to the data signal. The OLED has the anode electrode coupled to the second electrode of the third transistor M3 and has the cathode electrode coupled to the second power voltage ELVSS to generate light corresponding to the driving current generated by the first transistor M1.

The first power voltage ELVDD as a high potential power voltage is coupled to the first electrode of the first transistor M1 and the second power voltage ELVSS as a low potential power voltage having a lower level voltage than the first power voltage ELVDD is coupled to the cathode electrode of the OLED. For example, the first power voltage ELVDD may have a positive voltage and the second power voltage ELVSS may have a negative voltage.

In the frame period shown in FIG. 2, during the non-emission period Pb, the scan signals are supplied to the pixels 110 to write the data signals to the pixels 110. In the non-emission period Pb, the supply of the emission control signals is blocked. Therefore, the third transistor M3 included in each of the pixels 110 maintains a turn off state in the non-emission period Pb to prevent driving current from flowing to the OLED. Therefore, since the OLED does not emit light in the non-emission period Pb, a black image is displayed on the pixel unit 120.

In the frame period shown in FIG. 2, during the emission period Pe, the emission control signals are simultaneously supplied to the pixels 110. Therefore, the pixels 110 emit light with the brightness corresponding to the voltage of the storage capacitor Cst so that an image may be displayed during the emission period Pe.

The structure of the above-described pixel 110 corresponds to an embodiment for realizing the non-emission period Pb and the emission period Pe in each frame period and is not limited to the embodiment. Other embodiments may alternatively be used.

The DC-DC converter 170 receives an input power voltage Vin from the outside and converts the input power voltage Vin to generate the first power voltage ELVDD and the second power voltage ELVSS supplied to the pixels 110. The first power voltage ELVDD generated by the DC-DC converter 170 is supplied to the pixel unit 120 through a first power source line 201 and the second power voltage ELVSS is supplied to the pixel unit 120 through a second power source line 202. In addition, the DC-DC converter 170 starts to be driven when a driving signal Fon is received from the timing controller 160 to perform the operations of generating and supplying the first power voltage ELVDD and the second power voltage ELVSS.

When a stop signal Bs is supplied from the current sensing unit 180 even when the driving signal Fon is supplied, the DC-DC converter 170 may stop the supply of the first power voltage ELVDD. In addition, if the supply of the first power voltage ELVDD is stopped, the supply of the second power voltage ELVSS may also be stopped.

The DC-DC converter 170 may reduce the voltage of the first power voltage ELVDD in the non-emission period Pb in order to reduce power consumption. That is, the voltage of the first power voltage ELVDD supplied in the non-emission period Pb may be set as a lower value than the voltage of the first power voltage ELVDD supplied in the emission period Pe. At this time, the first power voltage ELVDD may be set as a positive voltage and the second power voltage ELVSS may be set as a negative voltage.

The input power voltage Vin may be supplied from a battery for providing a direct current (DC) power voltage or from a rectifying device for converting an alternating current (AC) power voltage into the DC power voltage to output the DC power voltage as the input power voltage Vin. However, the input power voltage Vin is not limited to the above.

The current sensing unit 180 measures the amount of current that flows through the first power source line 201 in the non-emission period Pb in the frame period to supply the stop signal Bs to the DC-DC converter 170 and to stop the operation of the DC-DC converter 170 if the amount of measured current is greater than a reference current value.

In the emission period Pe, since the pixels 110 emit light, the current that flows from the first power voltage ELVDD to the second power voltage ELVSS flows through the first power source line 201. Since the current that flows through the first power source line 201 changes in accordance with the brightness of the pixels 110, relatively small current caused by a short flowing through the first power source line 201 is difficult to sense.

On the other hand, since the pixels 110 do not emit light in the non-emission period Pb, current does not flow from the first power voltage ELVDD to the second power voltage ELVSS so that current should not flow through the first power source line 201. However, if the first power source line 201 is shorted, even though only a small current caused by the short flows through the first power source line 201, it is possible to measure the minute current. Therefore, the measured current is compared with a reference current value to correctly determine whether a short is generated. When a sensing signal Con is received from the timing controller 160, the current sensing unit 180 may measure the current of the first power source line 201 and may determine whether the stop signal Bs is output. In addition, the reference current value may be changeably set, for example, by a manufacturing company by reflecting the size, purpose, and environment and may be from about 0 mA to several mA.

Figure 4:
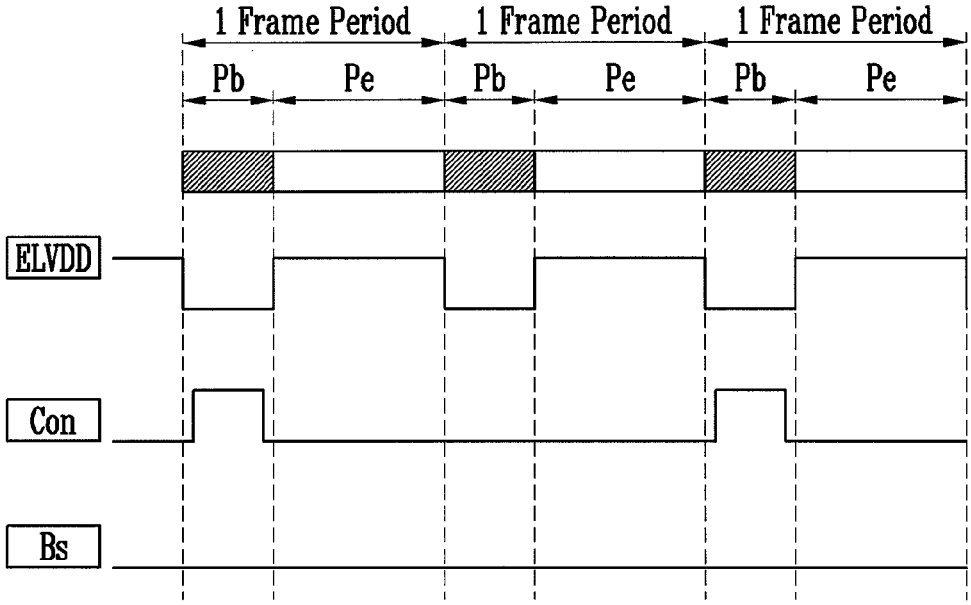
FIG. 4 is a timing diagram illustrating the normal operation of the organic light emitting display according to an embodiment.
Figure 5:
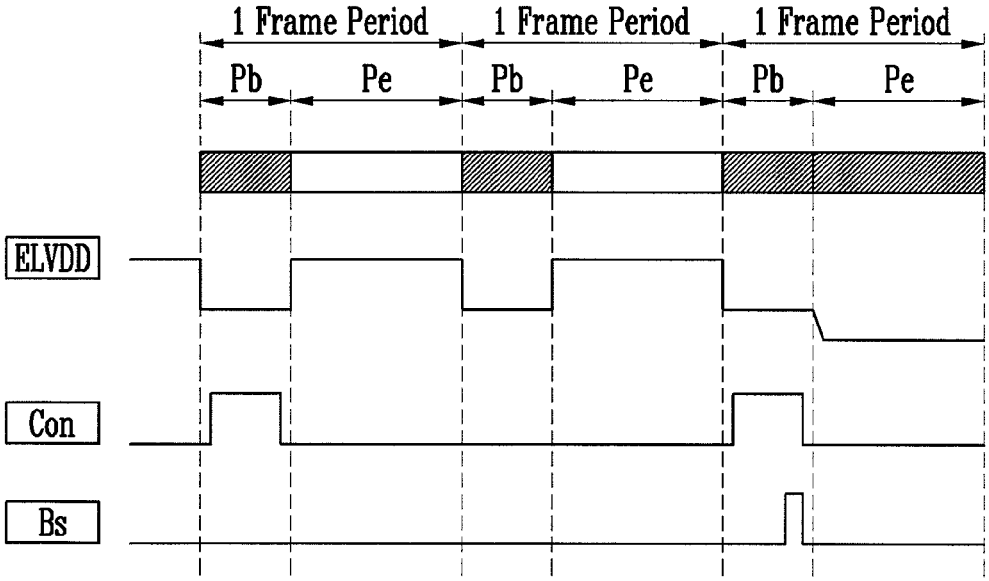
FIG. 5 is a timing diagram illustrating the operation of the organic light emitting display according to an embodiment when a short is generated.

FIG. 4 is a timing diagram illustrating the normal operation of the organic light emitting display according to an embodiment. FIG. 5 is a timing diagram illustrating the operation of the organic light emitting display according to the embodiment when a short is generated.

Each frame period includes the non-emission period Pb and the emission period Pe. The non-emission period Pb may be performed before the emission period Pe. The first power voltage ELVDD may be reduced to a predetermined voltage in order to reduce power consumption during the non-emission period Pb and may be restored to a normal voltage during the emission period Pe.

The timing controller 160 supplies the sensing signal Con to the current sensing unit 180 during the non-emission period Pb. The current sensing unit 180 that received the sensing signal Con measures the amount of current that flows through the first power source line 201. When the amount of measured current is greater than or equal to a reference current value, the stop signal Bs is supplied to the DC-DC converter 170 and the stop signal Bs is not supplied when the amount of measured current is less than the reference current value.

Since FIG. 4 illustrates a normal case in which short does not exist, the stop signal Bs is not generated. When the stop signal Bs is not generated, the DC-DC converter 170 determines that the current state is a normal state in which a short does not exist and maintains the output of the first power voltage ELVDD.

Referring to FIG. 5 in which illustrates the operation of the device when a short does exist, and the current sensing unit 180 supplies the stop signal Bs to the DC-DC converter 170. The DC-DC converter 170 that received the stop signal Bs stops the output of the first power voltage ELVDD. Therefore, the DC-DC converter 170 may turn off all of the switching elements (for example, transistors) that exist in the DC-DC converter 170. Therefore, since the first power voltage ELVDD is not supplied after the stop signal Bs is not supplied, it is possible to prevent additional damage from being caused by the short, such as a fire.

In FIGS. 4 and 5, it is illustrated that the current sensing unit 180 operates once every two frame periods. However, the current sensing unit 180 may operate every frame period and may intermittently operate in accordance with another period. That is, the current sensing unit 180 may intermittently operate considering power consumption and may operate every frame period in an apparatus where frequent checking is preferred.

While various features and aspects have been described in connection with certain exemplary embodiments, it is to be understood that the invention is not limited to the disclosed embodiments, but, on the contrary, is intended to cover various modifications and equivalent arrangements.

What is claimed is:

1. An organic light emitting display, comprising:

a pixel unit configured to display images in a plurality of frame periods, the frame period having a single non-emission period immediately followed by a single emission period;

wherein the pixel unit is further configured to display a black image during the non-emission period and further configured to display an image according to data signals during the emission period of every frame period;

a DC-DC converter configured to supply a first power voltage to the pixel unit through a first power source line and configured to permanently stop supply of the first power voltage when a stop signal is received; and a current sensing unit configured to measure an amount of current that flows through the first power source line only during the non-emission period of the frame period and further configured to supply the stop signal to the DC-DC converter if the amount of measured current is greater than or equal to a reference current value, wherein the stop signal has a duration less than the non-emission period.

2. The organic light emitting display as claimed in claim 1, wherein the DC-DC converter is further configured to supply a second power voltage to the pixel unit through a second power source line.

3. The organic light emitting display as claimed in claim 2, wherein the pixel unit comprises pixels coupled to scan lines, data lines, the first power source line, and the second power source line.

4. The organic light emitting display as claimed in claim 3, further comprising:

a scan driver configured to supply scan signals to the pixels through the scan lines; and a data driver configured to supply the data signals to the pixels through the data lines.

5. The organic light emitting display as claimed in claim 2, wherein the first power voltage has a positive voltage, and wherein the second power voltage has a negative voltage.

6. The organic light emitting display as claimed in claim 1, wherein the DC-DC converter is configured to set a voltage level of the first power voltage during the non-emission period to be less than a voltage level of the first power voltage supplied during the emission period.

7. The organic light emitting display as claimed in claim 1, wherein the current sensing unit is configured to measure the amount of current every frame period.

8. The organic light emitting display as claimed in claim 1, wherein the current sensing unit is configured to measure the amount of current every other frame period.

9. The organic light emitting display as claimed in claim 1, wherein the current sensing unit is configured to measure the amount of current periodically.

10. A method of driving an organic light emitting display, the method comprising:

displaying images in a plurality of frame periods, the frame period having a single non-emission period immediately followed by a single emission period;

displaying a black image in the non-emission period and displaying an image based on data during the emission period of each frame period;

measuring an amount of current of a first power source line only during the non-emission period of the frame period;

wherein the first power source line is configured to transmit a first power voltage from a DC-DC converter to a pixel unit;

supplying a stop signal to the DC-DC converter if the amount of measured current is greater than or equal to a reference current value; and permanently stopping supply of the first power voltage if the DC-DC converter receives the stop signal, wherein the stop signal has a duration less than the non-emission period.

11. The method as claimed in claim 10, wherein the first power voltage has a positive voltage.

12. The method as claimed in claim 10, wherein the amount of current is measured every frame period.

13. The method as claimed in claim 10, wherein the amount of current is measured every other frame period.

14. The method as claimed in claim 10, wherein the amount of current is measured periodically.

15. The method as claimed in claim 10, wherein the voltage level of the first power voltage supplied during the non-emission period is less than the voltage level of the first power voltage supplied during the emission period.

16. An organic light emitting display, comprising:

a pixel unit configured to display images in a plurality of frame periods, the frame period having a single non-emission period immediately followed by a single emission period;

wherein the display unit is further configured to display a black image during the non-emission period and further configured to display an image according to data signals during the emission period of every frame period;

a power supply configured to supply a first power voltage to the pixel unit through a first power source line and further configured to permanently stop supply of the first power voltage when a stop signal is received; and a current sensing unit configured to measure an amount of current that flows through the first power source line only during the non-emission period of the frame period and further configured to supply the stop signal to the power supply if the amount of measured current is greater than a reference current value, wherein the stop signal has a duration less than the non-emission period.

17. The organic light emitting display as claimed in claim 16, wherein the power supply is further configured to generate a voltage level of the first power voltage during the non-emission period which is less than a voltage level of the first power voltage supplied during the emission period.

18. The organic light emitting display as claimed in claim 16, wherein the current sensing unit is configured to measure the amount of current every frame period.

19. The organic light emitting display as claimed in claim 16, wherein the current sensing unit is configured to measure the amount of current every other frame period.

20. The organic light emitting display as claimed in claim 16, wherein the current sensing unit is configured to measure the amount of current periodically.

* * * * *